US005272039A

United States Patent [19]

Yoerger

[11] Patent Number: 5,272,039

[45] Date of Patent: Dec. 21, 1993

[54] PREPARATION OF MAGNETIC CARRIER PARTICLES

[75] Inventor: William E. Yoerger, Rochester, N.Y.

[73] Assignee: Eastman Kodak Company, Rochester, N.Y.

[21] Appl. No.: 877,921

[22] Filed: May 4, 1992

[51] Int. Cl.[5] ..... G03G 9/113

[52] U.S. Cl. ..... 430/108; 430/137

[58] Field of Search ..... 430/108, 109, 137

[56] References Cited

U.S. PATENT DOCUMENTS

| | | | |
|---|---|---|---|
| 1,315,017 | 9/1919 | Gravell | 148/6.14 |
| 1,696,036 | 12/1928 | Heinzman | 148/6.14 |
| 1,895,568 | 1/1933 | Curtin et al. | 148/6.14 |
| 1,895,569 | 1/1933 | Curtin et al. | 148/6.14 |
| 1,911,537 | 5/1933 | Tanner | 148/6.14 |
| 2,550,660 | 5/1951 | Amundsen et al. | 148/6.24 |
| 3,121,033 | 2/1964 | Stapleton | 148/6.24 |
| 3,632,512 | 1/1972 | Miller | 252/62.1 |
| 3,718,594 | 2/1973 | Miller | 252/62.1 |
| 3,806,375 | 4/1974 | McLeod | 148/6.24 |
| 3,879,237 | 4/1975 | Faigen et al. | 148/6.24 |
| 4,247,597 | 1/1981 | Russell, Jr. | 428/403 |
| 4,310,611 | 1/1982 | Miskinis | 430/107 |
| 4,316,752 | 2/1982 | Kronstein | 148/6.16 |
| 4,518,440 | 5/1985 | Phillips, Jr. | 148/6.14 |
| 5,039,587 | 8/1991 | Czech et al. | 430/108 |
| 5,096,797 | 3/1992 | Yoerger | 430/108 |

OTHER PUBLICATIONS

Derwent Abstract No. 84-266308/43 of Japanese Laid-Open Appln. No. J59162-224-A, published Sep. 13, 1984.

*Primary Examiner*—John Goodrow

*Attorney, Agent, or Firm*—Robert Luke Walker

[57] ABSTRACT

Electrostatographic carrier particles with improved conductivity and stability are prepared from magnetic stainless steel particles. The particles are treated by submersion in an aqueous oxalic acid solution. The passivated stainless steel carrier particles, preferably after being first coated with a resin, may then be mixed with toner powder for electrographic dry development.

8 Claims, No Drawings

PREPARATION OF MAGNETIC CARRIER PARTICLES

FIELD OF INVENTION

This invention relates to electrostatography. More particularly it relates to an improvement in the preparation of magnetic carrier particles for use in the dry development of electrostatic charge images.

BACKGROUND

Electrostatography, which broadly includes the forming and developing of electrostatic image patterns either with or without light, has become a major field of technology. It perhaps is best known through the use of electrophotographic office copying machines. With the increased use of plain paper copiers, dry developers have enjoyed an increased popularity over liquid toners. Along with the increased use of dry developers magnetic brush development has become increasingly popular as opposed to cascade development.

Magnetic brush development uses ferromagnetic carrier particles, usually coated with a resin which aids in triboelectrically charging the toner. A magnet carries the developer mixture of toner and carrier particles and the magnetic field causes the carrier particles to align like the bristles of a brush. As the developer brush contacts the electrostatic latent image formed on a photoconductive or dielectric surface, toner particles are drawn away from the carrier particles by the oppositely charged electrostatic image. This alignment of the carrier particles toward the photoconductor surface will decrease the distance between carrier particles and the photoconductor surface. This provides the-effect of a development electrode with very close spacing to the photoconductor surface, which results in high quality tonal characteristics in the reproduced image. The higher the conductivity of the ferromagnetic carrier particles, the greater will be their effectiveness as a development electrode. The copying process may be completed by transferring the toned image to paper where it is fused and fixed, for instance, by pressing the paper with a heated roller.

Also, it is well-known that for high speed copiers a rapid development rate is necessary if high density images are to be achieved. Such rapid development rates are facilitated by using carrier particles having a highly conductive carrier core. Ferromagnetic carrier particles such as, for example, stainless steel are desirable for this purpose due to their excellent conductivity and stability.

Unfortunately, stainless steel typically has a layer of scale, or oxide, on the surface due to its method of manufacture which serves to decrease its conductivity slightly. It is therefore desirable to remove this scale to make the stainless steel more conductive and cause a corresponding increase in development rate.

It is known that certain acids may be used to remove oxides from metals. For example, U.S. Pat. No. 4,310,611 to Miskinis discloses passivating stainless steel electrographic carrier particles by treatment with nitric acid. Preferably, the stainless steel particles are treated first with a 1% HF solution for about 12 minutes, rinsed in a distilled water wash, and then treated with a 20% $HNO_3$ solution at 65° C. for about 20 minutes followed by a distilled water wash and a methanol rinse. The chemicals for this process are relatively expensive, and also relatively hazardous to work with, particularly at elevated temperatures.

Also, a variety of acid treatments have been disclosed for treating steel to increase corrosion resistance. A great deal of this work has utilized various acids, including oxalic acid, to apply protective coatings on to various metal surfaces.

For example, U.S. Pat. No. 4,316,752 to Kronstein discloses a method for improving the corrosion resistance of carbon steel or galvanized steel by treating the metal surface with a dilute aqueous oxalic acid solution having a temperature of 65° C. to 90° C., to form a passivated layer.

Japanese published Appln. No. J59-162,224 discloses a method for increasing the strength of stainless steel rods involving submersing the rods in liquid oxalic acid. The rods are then press-formed into bolts and given a solid solution heat treatment, allegedly resulting in bolts having higher strength than those made using ordinary methods.

A great deal of work has involved depositing oxalate coatings onto metal surfaces for, inter alia, corrosion resistance. For example, see U.S. Pats. Nos. 1,315,017; 1,696,036; 1,895,568; 1,895,569; 1,911,537; 2,550,660; 3,121,033; 3,806,375; and 3,879,237.

U.S. Pat. Nos. 3,632,512 and 3,718,594 to Miller discloses treating ferromagnetic carrier particles in an aqueous acid solution followed by rinsing and controlled drying to form a thin uniform layer of iron oxide on the iron particles which apparently improves particle conductivity. Miller states that acids such as sulphuric, other mineral acids, and certain organic acids, may be used to form this layer.

U.S. Pat. No. 4,247,597 to Russell, Jr. discloses treating ferromagnetic carrier particles with a carboxylic acid solution and allowing the solvent to evaporate, leaving a protective monomolecular layer of a non-halogenated carboxylic acid. Russell teaches that an anhydrous solution of carboxylic acid should be utilized to apply this acid layer, using a solvent such as methanol or methyl ethyl ketone.

U.S. Pat. No. 5,096,797 to Yoerger discloses treating strontium or barrium ferrite carrier particles with an aqueous acid solution to dissolve any loose strontium or barium oxide dust. One of the acids listed in this patent is oxalic acid. There is no suggestion, however, of using an aqueous oxalic acid solution to remove scale and improve the conductivity of stainless steel carrier particles.

It would be desirable to find a simple method to remove scale from stainless steel, and thus increase the conductivity of the stainless steel, using fewer and/or cheaper chemicals, and preferably at room temperature.

BRIEF SUMMARY OF THE INVENTION

In accordance with the present invention, a method for increasing the conductivity of stainless steel carrier particles for use in electrostatography is provided in which the stainless steel carrier particles are immersed in an aqueous oxalic acid solution followed by a thorough rinsing. The oxalic acid solution may be heated or maintained at room temperature. Preferably, after treatment by the oxalic acid, the particles are first rinsed in water and thereafter in a volatile water miscible solvent such as acetone or a lower alcohol such as methanol, ethanol or isopropanol.

The novel carrier component formed using this method of the invention comprises a mass of particles of highly conductive and stable ferromagnetic stainless steel. The surface of these stainless steel carrier particles comprises a thin, tightly adherent, chromium-rich layer. Optionally, after oxalic acid treatment, the particles can be coated with a resin which aids in the triboelectric charging of the toner, but which preferably is discontinuous or thin enough that the particle mass remains conductive. These novel carrier particles can then be mixed with a toner for use as a high speed developer.

Although the applicant does not wish to be bound by theoretical explanations, it appears that the oxalic acid treatment of the stainless steel carrier particles in accordance with the invention apparently rids the particle surface of iron oxide, enriching the surface in chromium to form a layer that is chemically stable and inert under electrographic development conditions. This process utilizes relatively safe and inexpensive chemicals in comparison to those previously used by the prior art to increase conductivity. The resultant stainless steel carrier particles exhibit excellent conductivity and stability and good adhesion to resins with which the particles are commonly coated.

DETAILED DESCRIPTION—INCLUDING PREFERRED EMBODIMENTS

The term stainless steel designates a family of alloy steels of sufficiently high chromium content, e.g., at least 9 weight percent, to resist the corrosion or oxidation to which ordinary carbon steels are susceptible in a moist atmosphere. Not all stainless steels, however, are useful as electrographic carrier materials in accordance with the invention. The steel must be ferromagnetic. Two types that meet this requirement are martensitic stainless steels, which contain from 10 to 18 weight percent chromium, and ferritic stainless steels, which contain from 15 to 30 weight percent chromium. Austenitic stainless steels contain a large amount of nickel (6 to 22 weight percent) and normally are nonmagnetic in the annealed condition.

In accordance with the invention, the preferred method of increasing the conductivity of stainless steel carrier particles is by submersion in an aqueous oxalic acid at room temperature. However, this is not meant to limit the temperature, and alternatively, the oxalic acid solution could be heated. Following oxalic acid treatment the stainless steel powder is rinsed, preferably in water, and then optionally in a volatile water miscible solvent such as acetone or a lower alcohol such as, for example, methanol, ethanol or isopropanol. The rinsed carrier particles are then dried, e.g., by agitating them in a current of warm air or nitrogen, to leave stainless steel carrier particles in which the surface scale has been removed, and consequently the conductivity has been increased. This method is simpler than methods disclosed in the prior art, and generally utilizes less expensive chemicals. Further, the present method is-less hazardous than previous methods, because it uses relatively less hazardous chemicals and is done at room temperature.

The conductivity seen after the aqueous oxalic acid treatment appears to increase as exposure to acid increases, both with regard to the time exposed and the concentration of acid in solution. If the process is practiced at room temperature, as in the case of the preferred embodiment, the concentration of acid in solution is limited to its saturation point in water at room temperature. Consequently, acid concentrations above 10% are probably unattainable at room temperature. However, if higher concentrations are desired, the solution could be heated, in which case the amount of oxalic acid needed to saturate the solution would increase, and consequently higher concentrations could be used. Acid concentrations of from 1 to 5 percent have shown particularly favorable descaling ability.

After aqueous oxalic acid treatment and rinsing, the stainless steel particles preferably are given a thin coating of a resin for triboelectric charging of the toner particles. Many resins are suitable. Examples include those described in the patent to McCabe, U.S. Pat. No. 3,795,617, the patent to Kasper, U.S. Pat. No. 3,795,618 and the patent to Kasper, et al., U.S. Pat. No. 4,076,857. The choice of resin will depend upon its triboelectric relationship with the intended toner. For use with well-known toners made from styrene-acrylic copolymers, preferred resins for the carrier coating include fluorocarbon polymers such as poly(tetrafluoroethylene), poly(vinylidene fluoride) and poly(vinylidene fluoride-co-tetrafluoroethylene).

The carrier particles can be coated by forming a dry mixture of treated stainless steel particles with a small amount of powdered resin, e.g., 0.05 to 0.30 weight percent resin, and heating the mixture to fuse the resin. Such a low concentration of resin will form a thin or discontinuous layer of resin on the stainless steel particles.

Since the oxalic acid treatment is intended to improve conductivity of carrier particles, the layer of resin on the carrier particles should be thin enough that the mass of particles remains conductive. Preferably the resin layer is discontinuous so that spots of passivated bare metal on each particle provide conductive contact. The coating can be continuous but if so it should be thin enough to retain sufficient conductivity for use in the electrical breakdown development method disclosed in U.S. Pat. No. 4,076,857 to Kasper.

The developer is formed by mixing the passivated, finely-divided particles of stainless steel with an electroscopic toner. Developers typically contain from about 85 to 99 weight percent carrier and about 1 to 15 weight percent toner.

The toner comprises a powdered thermoplastic resin which preferably is colored. It normally is prepared by finely grinding a resin and mixing it with a colorant, i.e., a dye or pigment, and any other desired addenda. The mixture is heated and milled, then cooled and crushed into lumps and finely ground again. Resulting toner particles may range in diameter from 0.5 to 25 microns with an average size of 2 to 15 microns being preferred.

The stainless steel carrier particles are larger than the toner particles, e.g., with an average particle size from 20 to 1000 microns and preferably 40 to 500 microns. A convenient way of obtaining particles of the preferred particle size range is by screening a mass of particles with standard screens. Particles that pass through a 35 mesh screen and are retained on a 325 mesh screen (U.S. Sieve Series) are especially suitable.

The toner resin can be selected from a wide variety of materials, including both natural and synthetic resins and modified natural resins, as disclosed for example in the patent to Kasper, et al., U.S. Pat. No. 4,076,857 of Feb. 28, 1978. Especially useful are the crosslinked polymers disclosed in the patent to Jadwin, et al., U.S. Pat No. 3,938,992 of Feb. 17, 1976 and the patent to Sadamatsu, et al., U.S. Pat. No. 3,941,898 of Mar. 2, 1976. The crosslinked or non-crosslinked copolymers of styrene or lower alkyl styrenes with acrylic monomers such as alkyl acrylates or methacrylates are particularly useful.

The toner can also contain minor components such as charge control agents and anti-blocking agents. Especially useful charge control agents are disclosed in U.S. Pat. No. 3,893,935 and British Pat. No. 1,501,065.

Stainless steel carrier particles treated in accordance with this invention exhibit increased conductivity over methods disclosed in the prior art. Electron spectroscopy for chemical analysis ("ESCA") indicates that the surface of the stainless steel carrier particles has enhanced chromium after aqueous oxalic acid treatment. It is believed that this phenomenon is responsible for the increased conductivity and stability exhibited by the treated stainless steel carrier particles.

The invention may be more easily comprehended by reference to a specific example which is representative of the present invention. It must be understood, however, that this example is provided only for purposes of illustration, and that the invention may be practiced otherwise than as specifically illustrated without departing from its spirit and scope.

EXAMPLE 1

One hundred gram samples of Ametek 410L stainless steel carrier particles having a particle size between about 106 to 175 microns were treated with oxalic acid by immersing the particles in aqueous solutions of oxalic acid having the percentages listed in Table 1 for a period of forty-five minutes to remove the surface scale.

The stainless steel carrier was stirred in aqueous oxalic acid, having been previously dissolved in distilled water. During this time a yellowish precipitate developed which was analyzed as being a hydrated FE(III) oxalate. The solution also took on a purplish color which was analyzed to contain a slight amount of iron but primarily chromium. At the end of the reaction time, the treating solution was decanted and the carrier thoroughly washed with distilled water to remove any residual precipitate and treatment chemicals. Lastly, the carrier particles were given a methanol rinse to help remove any residual water and organic material. ESCA was performed on the carrier both before and after passivation. Subsequent to the treatment the carrier particles exhibited an enhancement of chromium on the surface. The following table shows the effect of various oxalic acid concentrations on conductivity and thermal stability to reoxidation. Conductivity was measured as follows: Equal weight samples of treated and untreated carrier particles were collected. To measure conductivity, each sample was compressed an equal amount between two circular plates. The two plates were then used as the electrodes between which resistance measurements were taken. For purposes of comparison, stainless steel carrier particles were also treated by HF followed by $HNO_3$. The results are listed in Table I. To simulate typical reoxidation conditions encountered while applying a charge modifying polymer, samples were heated at 230° C. for two hours. This is the typical treatment method for applying a charge modifying polymer of poly (vinylidene fluoride) such as, for example, Kynar 301F resin, onto the carrier particle surface.

TABLE I

| Acid | Solution pH | Resistance (Ohms) Before Heat | Resistance (Ohms) After Heat | % Carrier weight loss |
|---|---|---|---|---|
| NONE | — | $8.5 \times 10^6$ | — | — |
| 1% oxalic | 1.35 | 0.3 | 110 | 0.8% |
| 2% oxalic | 1.09 | 0.4 | 16.9 | 1.2% |
| 3% oxalic | 0.97 | 0.15 | 3.2 | 2.2% |
| 1% HF / 20% $HNO_3$ | | 0.9 | 149 | N.R. |

As illustrated in Table I, above, the resultant conductivity and thermal stability to reoxidation exhibited by the treated stainless steel carrier particles is proportional to the acid's ability to descale the stainless steel carrier surface. The ability to descale the stainless steel particles increased as exposure to acid increased, both volume-wise and concentration-wise (up to a reasonable level). Consequently, as illustrated in Table I, as oxalic acid concentration increased, the resistivity decreased. All of the oxalic acid concentrations out performed the prior art HF/$HNO_3$ treatment. Further, the oxalic acid treatment also proved better for thermal stability, as evidenced by the resistivity measured after heating at 230° C.

The invention has been described in detail with particular reference to preferred embodiments thereof, but it will be understood that variations and modifications can be effected within the spirit and scope of the invention.

I claim:

1. A process for preparing carrier particles for use in the dry development of electrostatic charge patterns, comprising:

contacting stainless steel particles with an aqueous solution of oxalic acid;

removing said stainless steel particles from said solution; and rinsing the oxalic acid from said stainless steel particles.

2. The process as described in claim 1, wherein said oxalic acid solution is at room temperature.

3. The process as described in claim 1, wherein the particles are rinsed with water.

4. The process as described in claim 1, wherein the particles are rinsed with water followed by rinsing with a water miscible solvent.

5. The process as described in claim 1, wherein said aqueous solution of oxalic acid comprises between 1 and 15% oxalic acid.

6. The process as described in claim 1, wherein said aqueous solution of oxalic acid comprises between 1 and 5% oxalic acid.

7. A process for preparing resin-coated carrier particles for use in the dry development of electrostatic charge patterns, comprising:

contacting stainless steel particles with an aqueous solution of oxalic acid;

removing said stainless steel particles from said solution;

rinsing the oxalic acid from said stainless steel particles;

mixing said stainless steel particles with an amount of powdered resin; and heating said mixture to fuse the resin to said stainless steel particles.

8. The process as described in claim 17, wherein said amount of resin is between 0.05 and 0.30 weight percent resin.

* * * * *